US005517791A

United States Patent [19]

Weiss

[11] Patent Number: 5,517,791

[45] Date of Patent: May 21, 1996

[54] MONUMENT WITH MOVABLE ELEMENT

[76] Inventor: Hali J. Weiss, 32 Union Square East Ste. 411, New York, N.Y. 10003

[21] Appl. No.: 149,050

[22] Filed: Nov. 8, 1993

[51] Int. Cl.[6] ..... E04H 13/00

[52] U.S. Cl. ..... 52/103; 52/64; 52/105; 52/79.1; 40/124.5; 40/506

[58] Field of Search ..... 52/103–105, 65, 52/79.1, 64; 40/124.5, 506, 493

[56] References Cited

U.S. PATENT DOCUMENTS

| | | | |
|---|---|---|---|
| 819,394 | 5/1906 | Williams | 40/506 |
| 1,434,479 | 11/1922 | Chernock | 40/493 |
| 1,983,807 | 12/1934 | Norman | 40/124.5 |
| 1,994,937 | 3/1935 | Berger | 40/124.5 X |
| 3,570,159 | 3/1971 | Burgener | 40/124.5 X |
| 4,227,325 | 10/1980 | Whitford | 40/124.5 |
| 4,550,537 | 11/1985 | Smith | 52/103 |

FOREIGN PATENT DOCUMENTS

| | | | |
|---|---|---|---|
| 2052590 | 1/1981 | United Kingdom | 52/103 |
| 2210080 | 6/1989 | United Kingdom | 52/104 |

*Primary Examiner*—Robert J. Canfield
*Attorney, Agent, or Firm*—Howard J. Greenwald

[57] ABSTRACT

A monument comprised of a body, a device for permanently attaching the body to the ground, and a rotatable element rotatably attached to the body. The body contains an exterior surface with an opening; and at least a portion of the rotatable element is disposed within the opening. As the rotatable element is rotated, it displays visual information which varies with the rotation.

15 Claims, 13 Drawing Sheets

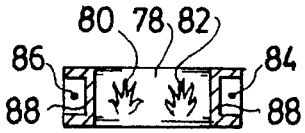
FIG.37
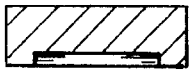
FIG.38
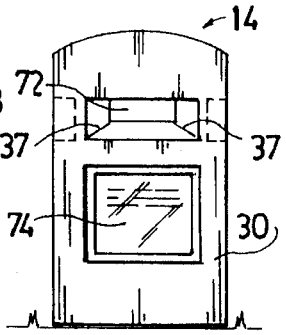
FIG.34
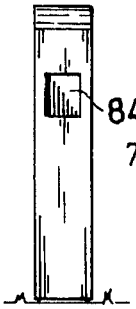
FIG.35
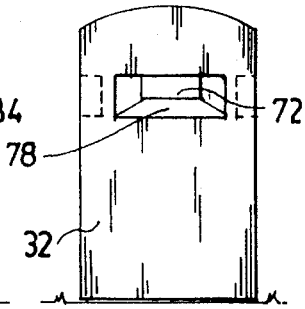
FIG.36
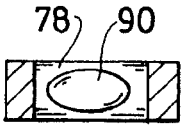
FIG 42
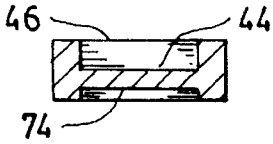
FIG.43
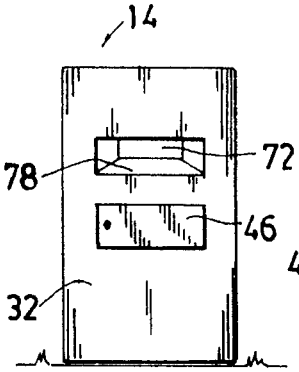
FIG.41
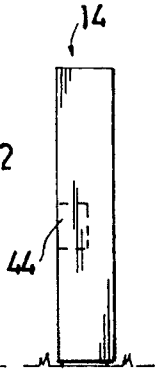
FIG.40
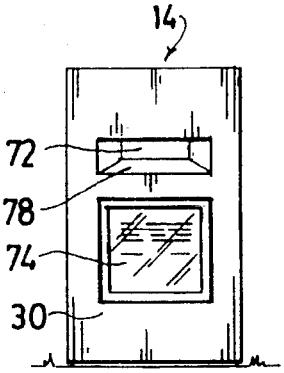
FIG.39
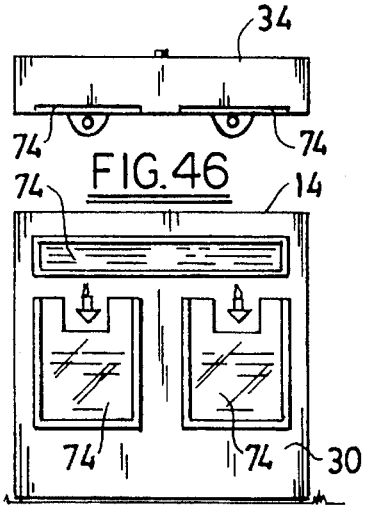
FIG.46
FIG.44
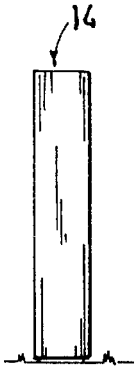
FIG.45
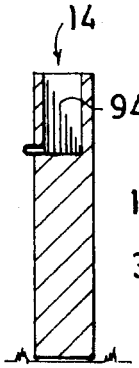
FIG.48
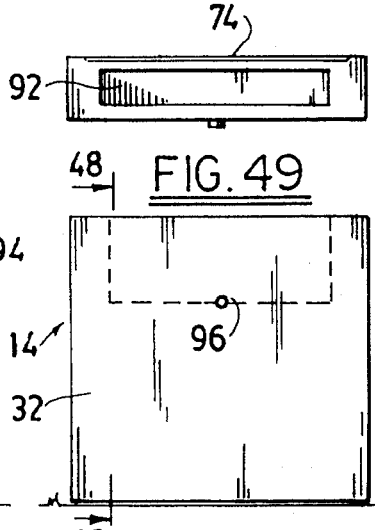
FIG.49
FIG.47

MONUMENT WITH MOVABLE ELEMENT

FIELD OF THE INVENTION

A monument for a grave which contains a movable element disposed on or in it.

BACKGROUND OF THE INVENTION

Grave monuments which contain non-structural elements are well known to those skilled in the art. Thus, by way of illustration and not limitation, reference may be had to U.S. design Pat. No. 259,369 of Splendora (which discloses a transparent monument containing a decorative object within it), U.S. design Pat. No. 310,419 of Morvant (which discloses a permanent photographic memorial marker), and U.S. utility Pat. Nos. 3,938,286 of Mochinski (a grave marker comprised of a lucite block), 3,962,836 of Carnes et al. (a grave marker with a transparent cover), 4,058,940 of McBrayer (a monument marker comprised of a clear plastic outer laminate), 4,202,144 of Patterson (a cemetery monument), 4,227,325 of Whitford (a grave marker comprised of a cylindrical chamber within which is mounted a picture), 4,259,381 of Narita (an ornament for burial monuments which contains a transparent body), 4,304,076 of Splendora (a transparent monument), 4,337,109 of Narita (a process for preparing a burial ornament), 4,428,168 and 4,428,169 of Tomer (a permanent floral decoration for use on grave sites), 4,550,537 of Smith (a grave monument), and the like. The disclosure of each of these United States patents is hereby incorporated by reference into this patent application.

To the best of applicant's knowledge, very few of the prior art publications relating to monuments disclose monuments with one or more movable elements affixed to them. Disclosures of such monuments may be found in U.S. Pat. Nos. 4,455,772 of Miller (a monument comprised of a sliding transparent panel), 4,463,527 of Schlosser (a grave marker with a removable cover), and 5,014,472 of Svensson (a tombstone with a openable inscription plate).

None of the prior art references discloses a monument with a movable element which can, at the option of the visitor, display selected portions of a relatively large amount of text.

It is an object of this invention to provide a monument with a rotatable element.

It is another object of this invention to provide a monument with a movable element which can display a relatively large amount of text.

It is another object of this invention to provide a monument with an interactive movable element which requires a visitor to move such element to have all of its contents fully disclosed to him.

It is another object of this invention to provide a monument with a movable element, which contains a substantially large amount of usable surface area.

SUMMARY OF THE INVENTION

In accordance with this invention, there is provided a monument for a grave site which comprises a movable element rotatably attached to such monument.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 34 is a front view of another preferred embodiment of the monument of this invention.

FIG. 35 is side view of the monument of FIG. 34.

FIG. 36 is a rear view of the monument of FIG. 34.

FIG. 37 is a plan sectional view of the monument of FIG. 34.

FIG. 38 is a plan view of the monument of FIG. 34.

FIG. 39 is a front view of another preferred embodiment of the monument of this invention.

FIG. 40 is a rear view of the monument of FIG. 39.

FIG. 41 is side view of the monument of FIG. 39.

FIG. 42 is a plan sectional view of the monument of FIG. 39.

FIG. 43 is another plan sectional view of the monument of FIG. 39.

FIG. 44 is a front view of another preferred embodiment of the moment of this invention.

FIG. 45 is side view of the monument of FIG. 44.

FIG. 46 is a plan view of the monument of FIG. 44.

FIG. 47 is a rear view of the monument of FIG. 44.

FIG. 48 is a sectional view of the monument of FIG. 44.

FIG. 49 is a plan sectional view of the monument of FIG. 44.

DESCRIPTION OF THE PREFERRED EMBODIMENTS

Figure 1:
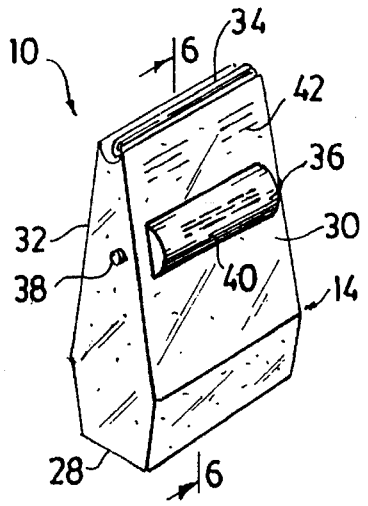
FIG. 1 is a perspective view of one preferred embodiment of the monument of this invention.
Figure 6:
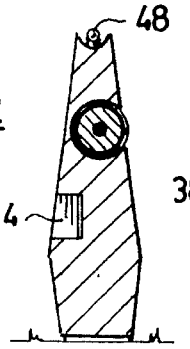
FIG. 6 is a sectional view of the monument of FIG. 1.
Figure 5:
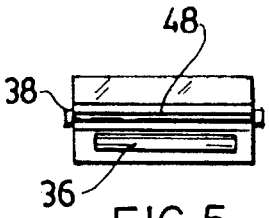
FIG. 5 is a plan view of the monument of FIG. 1.

FIG. 1 is a perspective view of one preferred monument 10 of this invention. As is known to those skilled in the art, a monument is an inscribed stone or other marker erected as a memorial.

Such monuments are well known to those skilled in the art. Thus, e.g., reference may be had to U.S. Pat. No. 3,938,286, which discloses an integral body having a generally upright member with a top and bottom and having a decorative exterior bearing identifying indicia. Thus, e.g., reference may be had to U.S. Pat. Nos. 3,962,836, 945,721, and 2,046,594, each of which discloses grave markers (such as those constructed of such relatively expensive materials such as bronze, brass, silver, and the like) and/or composite grave markers which include a transparent exterior member. Thus, e.g., reference also may be had to U.S. Pat. Nos. 4,058,940 and 2,124,143, which disclose grave markers constructed either from natural stone (such as granite) or manmade materials (such as acrylic plastic). Thus, e.g., reference also may be had to U.S. Pat. No. 4,169,970, which discloses tombstones and memorial monuments. Thus, e.g., reference also may be had to U.S. Pat. No. 4,202,144, which discloses a cemetery monument which includes a base and a main body section extending upwardly from the base, wherein such body section includes an outer shell formed of a plurality of textured, corrosion-resistant metal panels. Thus, reference also may be had to U.S. Pat. No. 4,227,325, which discloses a grave marker having a base, a marker, and a chamber for displaying pictures, photographs and the like. Reference may also be had to U.S. Pat. No. 4,304,076, which describes a monument comprising a single, unitary, substantially transparent molded member. Thus, e.g., reference may also be had to U.S. Pat. No. 4,550,537, which describes a monument consisting of a head and a base, both of which consist of stainless steel. Reference also may be had to U.S. Pat. Nos. 4,202,144, 4,009,547 (monument base), D243,466, 5,014,472, 3,857,214 (method of making tombstones), 3,481,089 (memorial marker with removable indicia), 3,477,181 (tombstone frames), and the like. The disclosure of each of these United States patents is hereby incorporated by reference into this specification.

Figure 2:
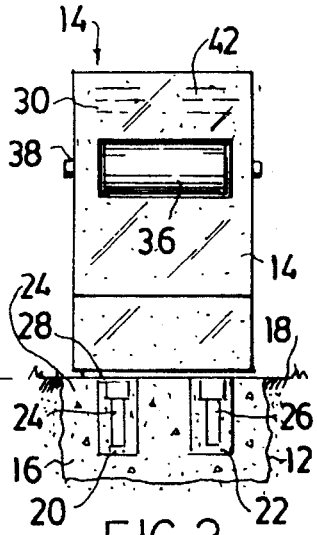
FIG. 2 is a front view of the monument of FIG. 1.

In one preferred embodiment, illustrated in FIG. 2, the monument 10 of this invention is comprised of a base 12 and a body 14.

Any conventional means for supporting body 14 of monument 10 may be used. Thus, by way of illustration and not limitation, one may use one or more of the concrete anchor arrangements well known to those skilled in the art. For example, one may use the devices illustrated in U.S. Pat. Nos. 5,107,650 (concrete anchors), 5,074,095, 5,063,724

(anchor for fixing a rod in concrete), 5,049,015, 4,872,298, and the like. The disclosure of each of these United States patent applications is hereby incorporated by reference into this specification.

Referring again to FIG. 2, and in the preferred embodiment illustrated therein, it will be seen that body 14 is mounted on concrete foundation 16 which is disposed within ground 18. This mounting means is well known to those skilled in the art. Thus, e.g., one may dig a suitable hole in the ground 18, and pour concrete 16 within such hole and allow it to harden so that it fills all of such hole except for recesses 20 and 22. Thereafter, steel anchors 24 and 26 are attached to the bottom surface 28 of body 14, and the body 14 with its attached steel anchors 24 and 26 are then disposed so that anchors 24 and 26 are within recesses 20 and 22. The recesses may be filled with wet concrete prior to the time the steel anchors 24 and 26 are inserted therein, or they may be filled with wet concrete thereafter. In either event, once the concrete within recesses 24 and 26 hardens, a substantially permanent means for mounting body 14 on ground 18 is formed. As will be apparent to those skilled in the art, this is but one means of durably mounting body 14.

Referring again to FIG. 1, and in the preferred embodiment illustrated therein it will be seen that body 14 is an upwardly extending structure which is comprised of a front face 30, a rear face 32, a bottom 28, and a top 34. It will apparent to those skilled in the art that, although the applicant has illustrated certain preferred shapes which may be used for the body 14 of monument 10, substantially any shape may be used.

The body 14, and/or the base 12, may consist essentially of any natural or manmade material. Thus, e.g., body 12 may comprise or consist essentially of granite, concrete and/or other ceramic material, stainless steel, acrylic, composite materials comprised of filler and matrix, and the like.

Referring again to FIG. 1, disposed within at least one surface of body 12 is a recess (not shown) adapted to receive rotatable cylinder 36. In the embodiment illustrated in FIG. 1, rotatable cylinder 36 is mounted on a shaft (not shown) which may be moved by means of knob 38 and, thus, may be continuously rotated by a visitor to the monument.

Referring again to FIG. 1, the rotatable cylinder 36 preferably has an inscription (not shown) on its circumferential surface 40. As cylinder 36 is rotated, the text of such inscription is gradually revealed by and to the visitor.

Rotatable cylinder 36 preferably is relatively lightweight and may be constructed, e.g., from copper, stainless steel, aluminum, bronze, plastic, titanium, and any other material which will provide a reasonable amount of chemical and weather resistance. The inscription on the surface of cylinder 36 may be made by conventional means such as, e.g., engraving, relief printing, stamping, printing, acid wash, etc.

In one preferred embodiment, cylinder 36 contains a hollow interior.

FIG. 2 is a front view of the monument of FIG. 1. Referring to FIG. 2, it will be seen that the front face 30 of monument 10 preferably is comprised of an inscription 42 preferably describing the name, birthplace, birthdate, death place, and death date of the deceased.

Figure 3:
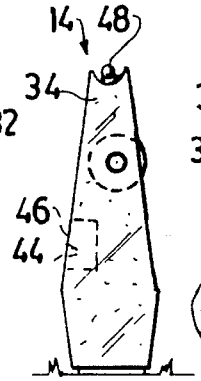
FIG. 3 is a side view of the monument of FIG. 1.

FIG. 3 is a side view of the monument 10 of FIG. 1. Referring to FIG. 3, it will be seen that, in the preferred embodiment depicted, monument 10 is also comprised of a compartment 44 which is enclosed by a movable, lockable door 46. It will also be noted that, in this embodiment, a decorative rod 48 (which preferably consists essentially of metal) may be disposed on top surface 34 of body 14.

Figure 7:
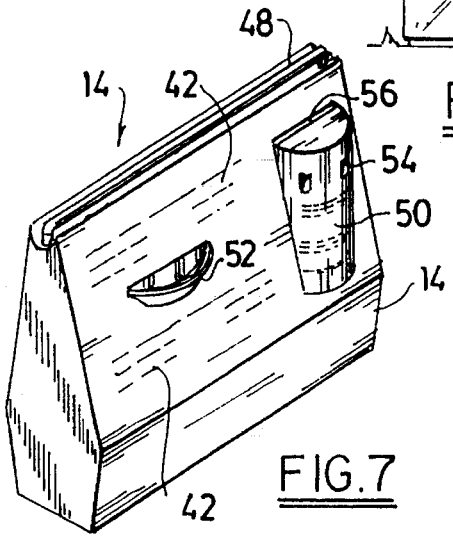
FIG. 7 is a perspective view of another preferred embodiment of the monument of this invention.
Figure 11:
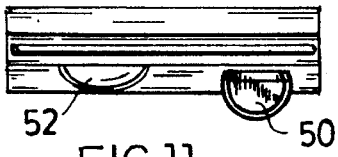
FIG. 11 is a plan view of the monument of FIG. 7.
Figure 10:
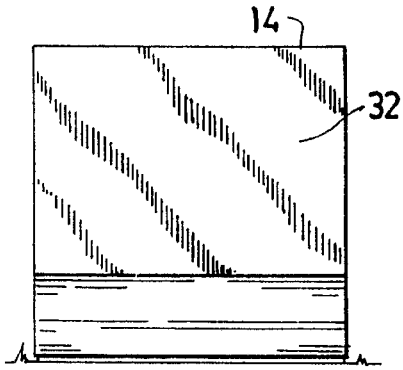
FIG. 10 is a rear view of the monument of FIG. 7.
Figure 9:
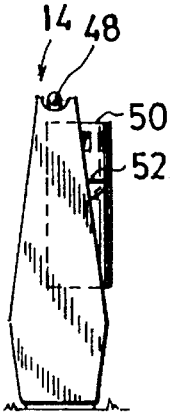
FIG. 9 is a side view of the monument of FIG. 7.
Figure 8:
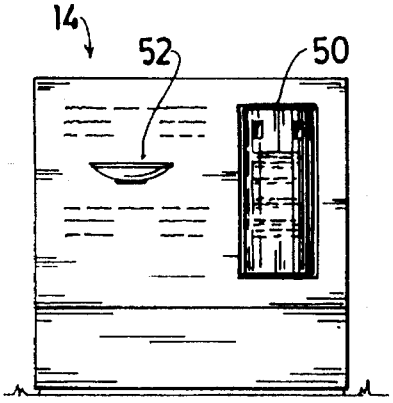
FIG. 8 is a front view of the monument of FIG. 7.

FIG. 7 is a perspective view of another preferred embodiment of monument 10 in which body 14 is comprised of an upwardly extending rotatable cylinder 50 and a horizontally extending receptacle 52 affixed to front face 30 and adapted to support a candle (not shown), a plant (not shown), and/or other article(s); the receptacle 52 may consist essentially of stone, metal, concrete, or any other suitable building material. In the embodiment illustrated in FIG. 7, cylinder 50 is comprised of recessed pulls 54 and 56 (and, optionally, other recessed pull(s) not shown) which allow a visitor to more readily rotate cylinder 50.

Figure 12:
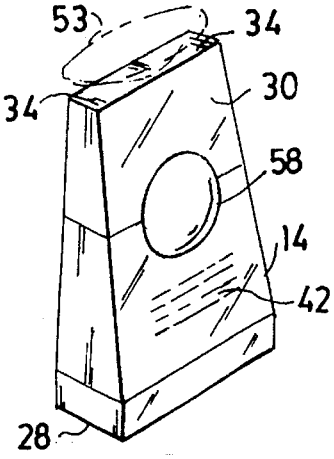
FIG. 12 is a perspective view of another preferred embodiment of the monument of this invention.
Figure 16:
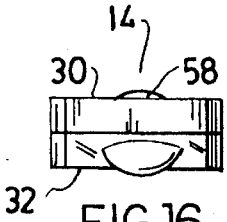
FIG. 16 is a plan view of the monument of FIG. 12.
Figure 17:
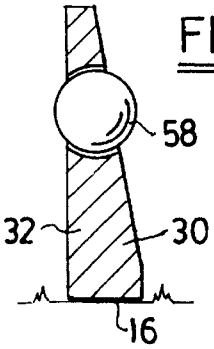
FIG. 17 is a sectional view of the monument of FIG. 12.
Figure 15:
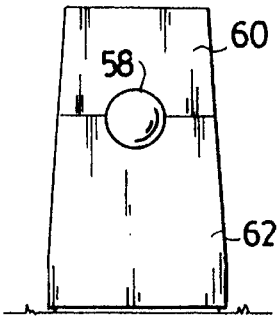
FIG. 15 is a rear view of the monument of FIG. 12.
Figure 14:
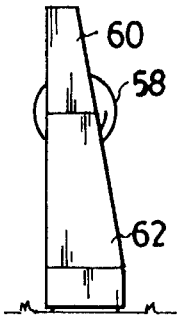
FIG. 14 is a side view of the monument of FIG. 12.
Figure 13:
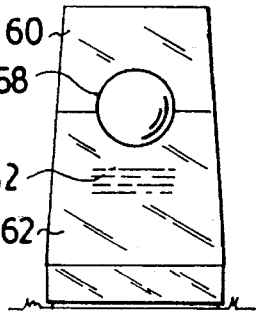
FIG. 13 is a front view of the monument of FIG. 12.

FIG. 12 is a perspective view of another preferred embodiment in which a rotatable, multi-directional sphere 58 is rotatably mounted within a recess (not shown) and contains a suitable inscription on its exterior surface. It will be apparent that a substantial amount of, or all of, the exterior surface of the rotatable sphere 58 may have the inscription applied to it. It will also be apparent that, because the recess (not shown) extends from front face 30 to rear face 32 of body 14, a visitor may read such inscription from either the front or the back of monument 10.

Although a rotatable sphere 58 is illustrated in these figures, it will be apparent that other rotatable, arcuate shapes may also be used. Thus, e.g., one may use rotatable ovoid. Alternatively, one may use a rotatable irregularly shaped object, or a rotatable polygonal object with five or more faceted sides.

Rotatable spheres 58 may consist essentially of any of the durable, relatively weather resistant materials described elsewhere in this specification such as, e.g., concrete, stone, plastic, bronze, stainless steel, aluminum, and the like. Some or all of the surface of sphere 58 may be inscribed in the manner disclosed elsewhere in this specification.

Referring again to FIGS. 12 et seq., and in the preferred embodiment illustrated therein, it will be seen that 53 is mounted on top surface 34 of body 14. Bowl 53 may consist essentially of any relatively durable material such as, e.g., stainless steel, granite, plastic, concrete, and the like.

Figure 18:
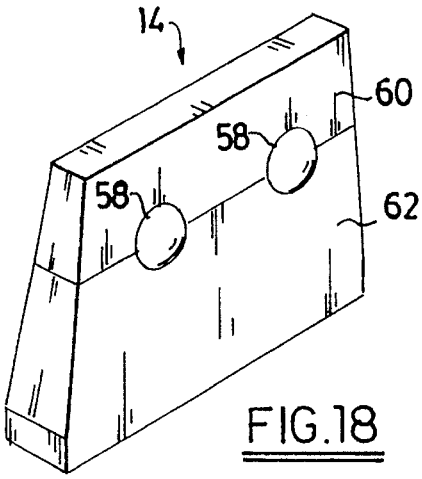
FIG. 18 is a rear perspective view of another preferred embodiment of the monument of this invention.
Figure 22:
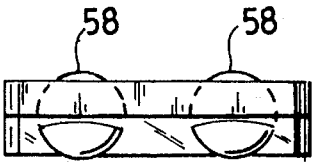
FIG. 22 is a plan view of the monument of FIG. 18.
Figure 21:
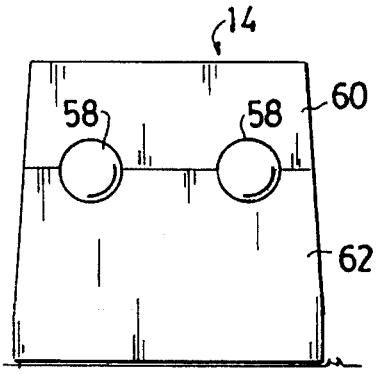
FIG. 21 is a rear view of the monument of FIG. 18.
Figure 20:
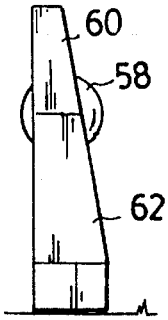
FIG. 20 is side view of the monument of FIG. 18.
Figure 19:
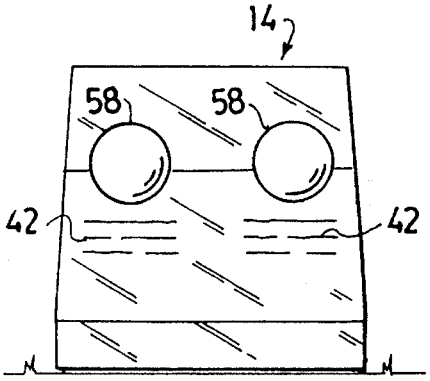
FIG. 19 is a front view of the monument of FIG. 18.

FIG. 18 is a rear perspective view of another preferred embodiment of body 14 which is comprised of two rotatable spheres 58. As will be apparent to those skilled in the art, in order to rotatably mount said spheres 58 within body 14, body 14 must be constructed from a top portion 60 and a bottom portion 62 which may be joined to each other by conventional means.

Figure 23:
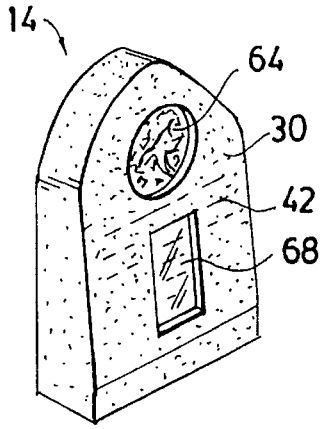
FIG. 23 is a perspective view of another preferred embodiment of the monument of this invention.
Figure 27:
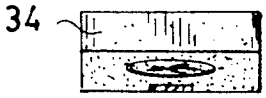
FIG. 27 is a plan view of the monument of FIG. 23.
Figure 24:
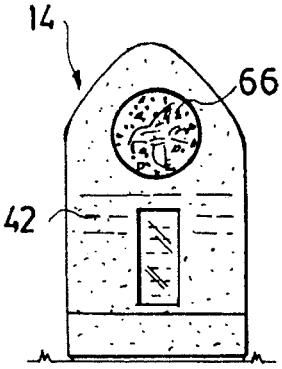
FIG. 24 is a front view of the monument of FIG. 23.

FIG. 23 is front perspective view of another preferred embodiment of body 14 of monument 10. In the embodiment depicted in FIG. 23, front face 30 of body 14 is comprised of a substantially circular recess 64 adapted to receive a mosaic 66 (see FIG. 24). As will be apparent to those skilled in the art, different mosaic designs may, at the option of the purchaser of the monument, be installed and/or removed from recess 64.

Referring again to FIG. 23, it will be seen that body 14 also preferably comprises a second recess 68 adapted to receive a metal plate (not shown in FIG. 23) which may contain a suitable inscription.

Figure 26:
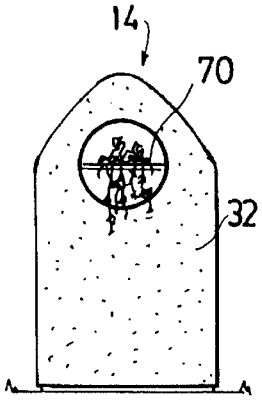
FIG. 26 is a rear view of the monument of FIG. 23.
Figure 25:
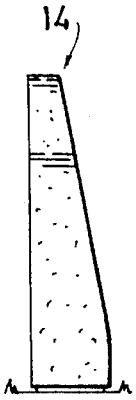
FIG. 25 is side view of the monument of FIG. 23.

FIG. 26 is a sectional view of the preferred body 14 illustrated in FIG. 23. Referring to FIG. 26, it will be seen that the back face 32 of body 14 is preferably comprised of a third recess 70 which is adapted to receive, e.g., a plant (not shown), a mosaic (not shown), a candle (not shown), or other suitable object(s).

Figure 28:
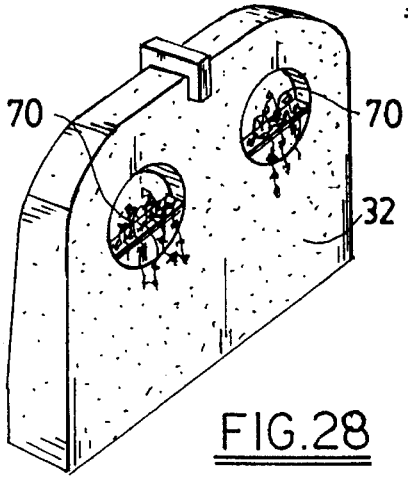
FIG. 28 is a rear perspective view of another preferred embodiment of the monument of this invention.
Figure 33:
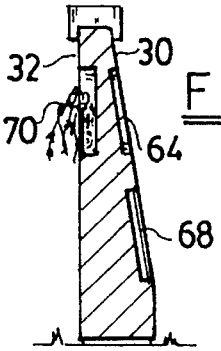
FIG. 33 is a sectional view of the monument of FIG. 28.
Figure 32:
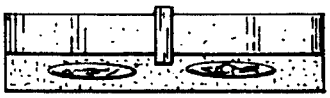
FIG. 32 is a plan view of the monument of FIG. 28.
Figure 31:
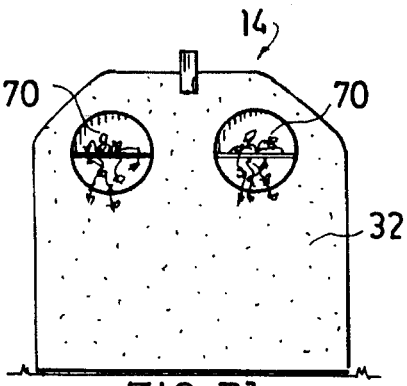
FIG. 31 is a rear view of the monument of FIG. 28.
Figure 30:
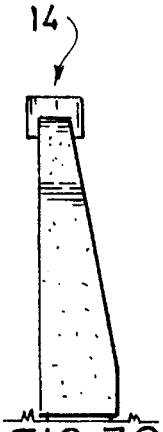
FIG. 30 is a side view of the monument of FIG. 28.
Figure 29:
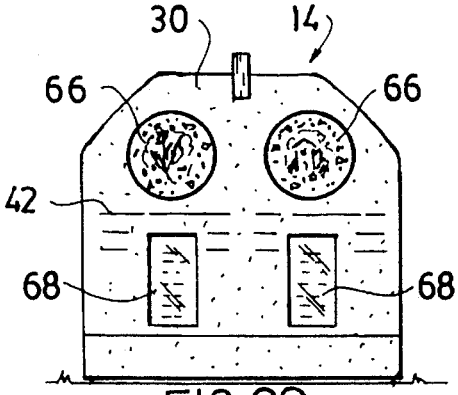
FIG. 29 is a front view of the monument of FIG. 28.
Figure 50:
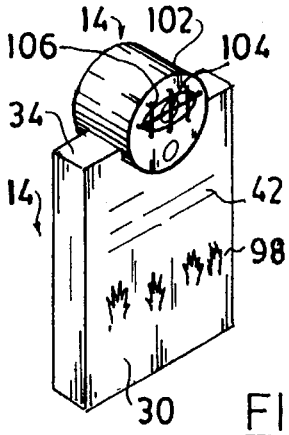
FIG. 50 is a front perspective view of another preferred embodiment of the monument of this invention.

FIG. 28 is a rear perspective view of another preferred embodiment of the invention which is comprised of two recesses 70 on its rear face 32, each of which is adapted to receive one or more of the objects described above.

FIGS. 34 to 47 disclose various embodiments of a monument 10 constructed from a multi-layered laminated structure which, depending to the extent it is cut away, will reveal different surface materials and appearances.

FIG. 34 is a front view of the front face 30 of a body 14 which is constructed from a first metal layer (not shown) and a second, different metal layer (not shown). As will be seen by reference to FIG. 34, front face 30 is comprised of a hole 72 and a recess 74. A plate (not shown in FIG. 34) may be attached within hole 72, preferably on its bottom horizontal surface 76. Alternatively, or additionally, a bowl or other decorative object may be attached within hole 72 on bottom horizontal surface 76.

FIG. 37 illustrates one embodiment of a plate 78 which may be attached within hole 72. This plate may contain an impression of the hands 80 and 82 of the deceased and/or other another person(s) and/or other objects; and it may contain, e.g., recesses 84 and 86 for candles (not shown). Tinted glass or plastic pieces 88 may be used to separate recesses 84 and 86 from impressions 80 and 82. As will be apparent to those skilled in the art, the deeper the recess 80 and/or 82 is, the more striated an appearance such recess will present.

The embodiment depicted in FIGS. 41 et seq. is similar to the embodiment of FIGS. 34 et seq. with the exceptions that (1) back face 32 is comprised of an additional lockable recess compartment 44 and a door 46, and (2) decorative plate 78 is comprised of a bowl-shaped recess 90.

The embodiment depicted in FIGS. 44 et seq. is similar to the embodiment of FIGS. 34 et seq. with the exception that (1) two front recesses 74 are provided which are adapted to receive a metal plate (not shown), (2) each of recesses 74 may have a different depth and, thus, present a different appearance, (3) the top surface 34 of the body 14 is comprised of a recess 92 adapted to receive a planter 94, and (4) a drain hole 96 is disposed in the back surface 32 of body 14 and is adapted to remove water from planter 94.

FIGS. 50 through 58 illustrate another preferred embodiment in which the body 14 is comprised of a front face 30 in which impressions 98 of the hands of survivors, or embedded objects 100 (such as, e.g., seashells or rocks) are disposed within such front face 30. The top wall 34 of body 14 is comprised of a recess (not shown) in which is disposed a chamber 102 which, preferably, is hollow, contains a document within its hollow interior, and is comprised of a magnifying lens 104 preferably protected by a metal grid 106. The lens 104 allows a visitor to more readily view the document within the chamber 102.

Figure 55:
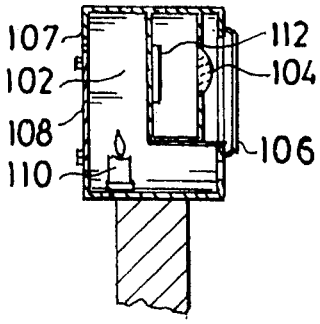
FIG. 55 is a sectional view of the monument of FIG. 50.
Figure 54:
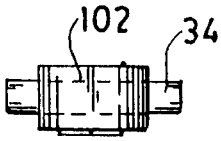
FIG. 54 is a plan view of the monument of FIG. 50.
Figure 53:
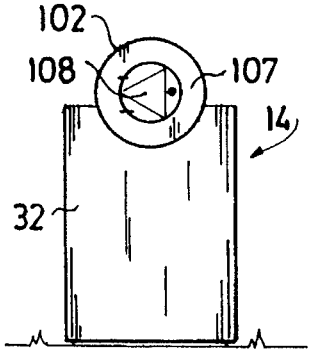
FIG. 53 is a rear view of the monument of FIG. 50.
Figure 52:
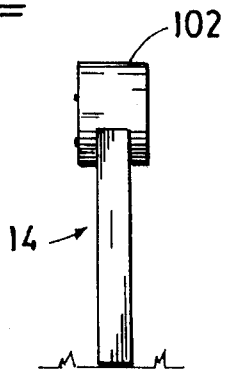
FIG. 52 is a side view of the monument of FIG. 50.
Figure 51:
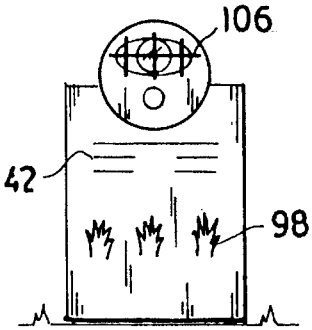
FIG. 51 is a front view of the monument of FIG. 50.

FIG. 55 illustrates one preferred embodiment of chamber 102 in which the back wall 107 of such chamber contains a door 108 which may be opened to allow candle 110 to be placed within such chamber. Referring to FIG. 55, document 112 may be viewed by placing one's eye 113 near or next to magnifying lens 104.

Figure 56:
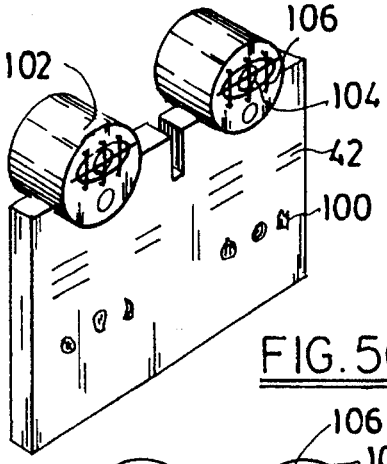
FIG. 56 is a perspective view of another preferred embodiment of the monument of this invention.
Figure 59:
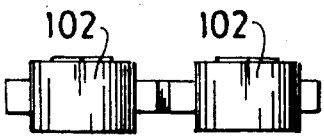
FIG. 59 is a plan view of the monument of FIG. 56.
Figure 57:
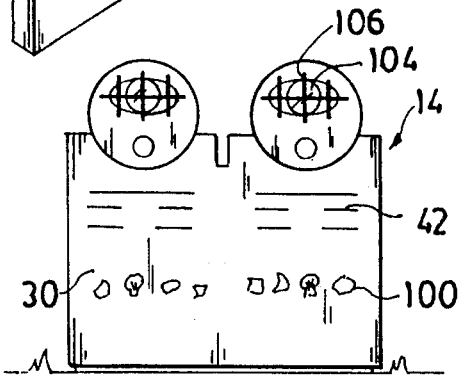
FIG. 57 is a front view of the monument of FIG. 56.
Figure 58:
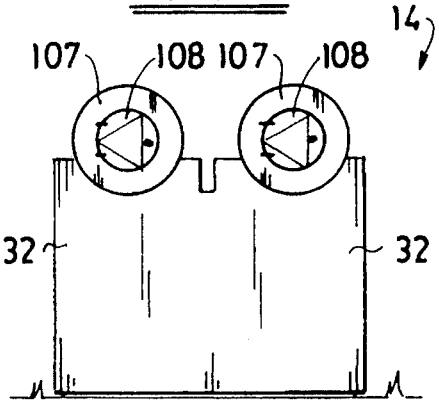
FIG. 58 is a rear view of the monument of FIG. 56.

The embodiment of FIGS. 56 through 58 are similar to those of FIGS. 50 through 55 with the exception that two chambers 104 are disposed on top wall 34.

FIGS. 60–73 and 81–83 illustrate embodiments in which the body 14 of monument 10 has a front face 30 and/or a rear face 32 in which one or more holes is disposed to receive a rectangular or square block which contains inscription(s) on one or more of its exterior surfaces.

Figure 60:
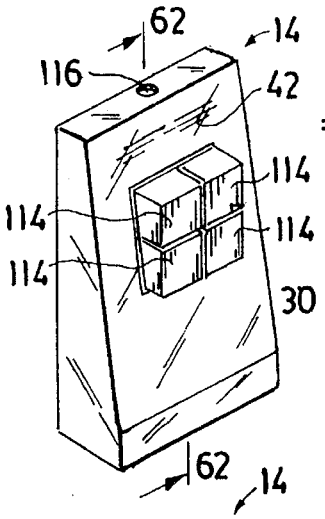
FIG. 60 is a front perspective view of another preferred embodiment of the monument of this invention.
Figure 65:
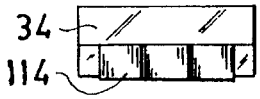
FIG. 65 is a plan view of the monument of FIG. 60.
Figure 64:
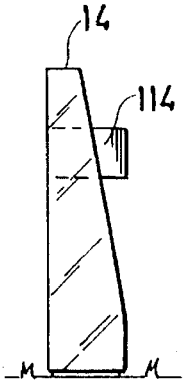
FIG. 64 is a side view of the monument of FIG. 60.
Figure 63:
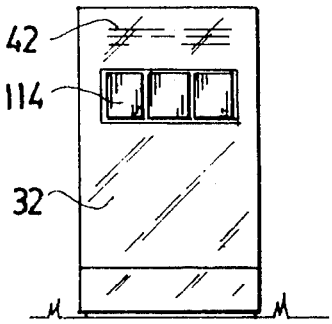
FIG. 63 is a rear view of the monument of FIG. 60.
Figure 61:
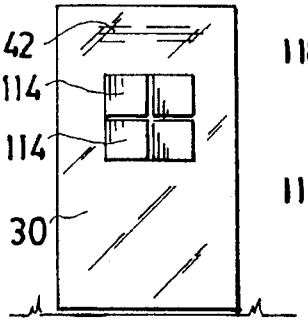
FIG. 61 is a front view of the monument of FIG. 60.

Referring to FIG. 60, it will be seen that body 14 is comprised of an orifice (not shown) in which one or more of blocks 114 is disposed. As will be apparent to those skilled in the art, one or more family members and/or friends may provide a suitable inscription on the surface(s) of block(s) 114 and insert them within the orifice (not shown). The blocks 114 may all have a similar texture and appearance, and/or they may have different textures and/or appearances and/or compositions.

Referring again to FIG. 60, and the preferred embodiment illustrated therein, it will be seen that top surface 34 of body 14 is comprised of a hole 116 adapted to receive a candle (not shown).

Figure 62:
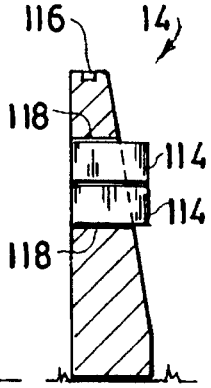
FIG. 62 is a sectional view of the monument of FIG. 60.

FIG. 62 is a sectional view of the body 14 of FIG. 60 showing that orifice 118 preferably extends from the front face 30 to the rear face 32 of body 14.

Figure 66:
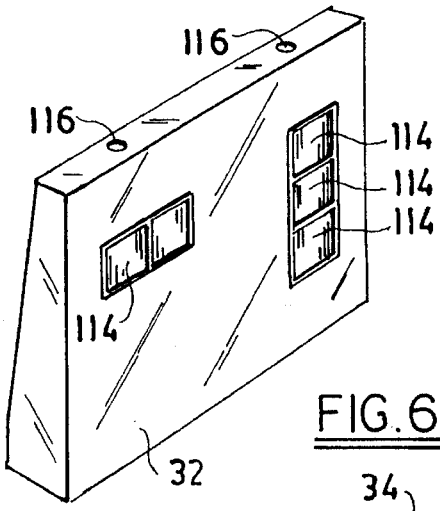
FIG. 66 is a rear perspective view of another preferred embodiment of the monument of this invention.
Figure 68:
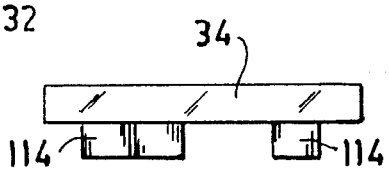
FIG. 68 is a front view of the monument of FIG. 66.
Figure 69:
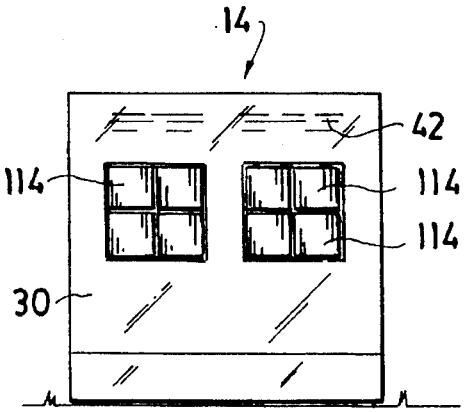
FIG. 69 is a plan view of the monument of FIG. 66.
Figure 67:
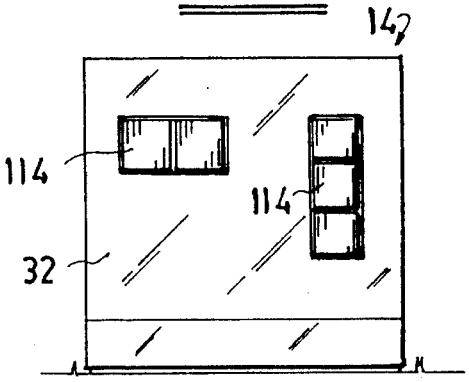
FIG. 67 is a rear view of the monument of FIG. 66.
Figure 72:
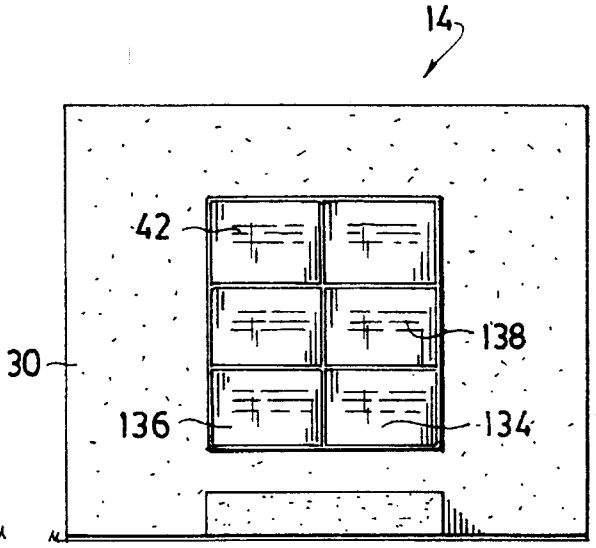
FIG. 72 is a front view of the monument of FIG. 70.

FIG. 66 depicts an embodiment of the body 14 which is similar to that depicted in FIG. 60 with the exception that two orifices are provided to receive blocks 114. Thus, the embodiment of FIG. 66 may be used as a monument for two people.

Figure 70:
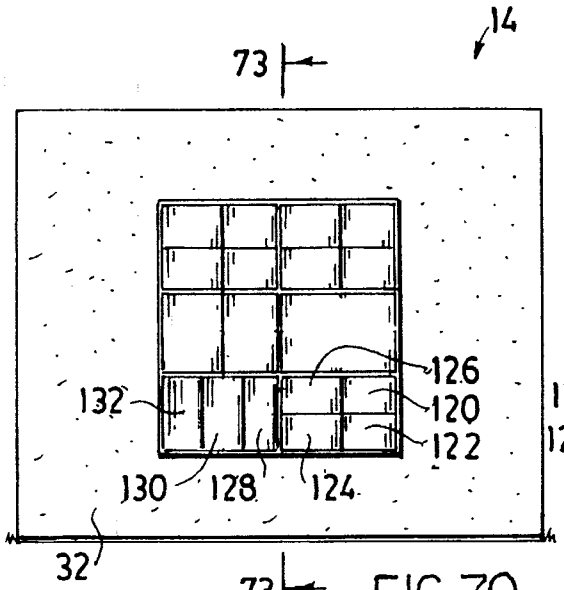
FIG. 70 is rear view of another preferred embodiment of the monument of this invention.
Figure 73:
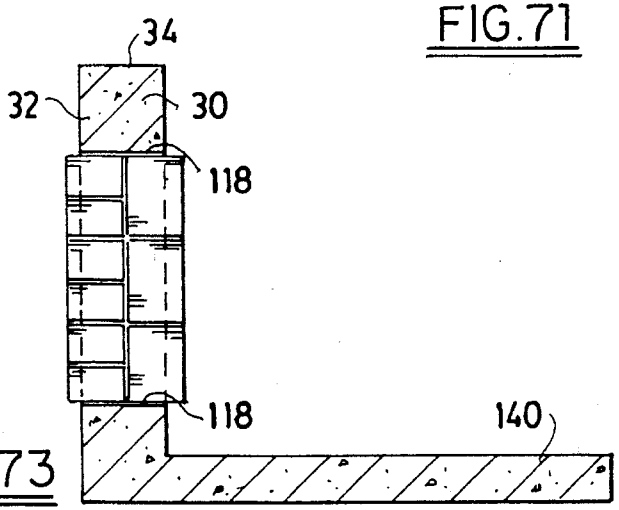
FIG. 73 is a sectional view of the monument of FIG. 70.
Figure 80:
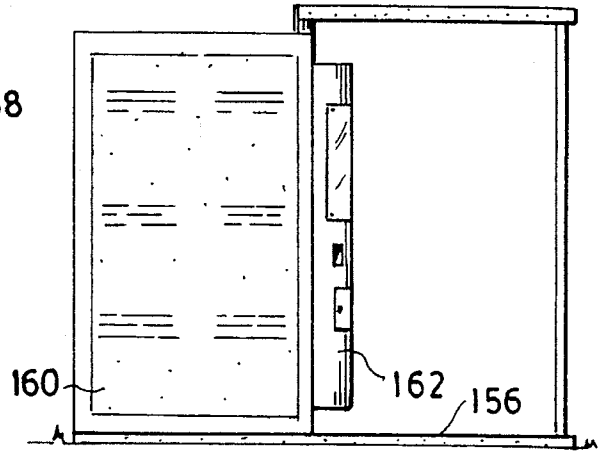
FIG. 80 is a side view of the monument of FIG. 79.

FIG. 70 illustrates an embodiment of body 14 which is similar to that depicted in FIG. 66 in that it can be used as a monument for at least two people. Referring to FIG. 70, which is rear view of body 14, it will be seen that back face 32 of body 14 is comprised of a large, centrally disposed orifice 118 which, as the need arises (by the death of one or more members of the family), may be filled with memory blocks.

Thus, for example, assuming that the husband in the family is the first to die, his wife, daughter, son, and partner may insert memory blocks 120, 122, 124, and 126 in the bottom right hand corner of orifice 118. These memory blocks may be made out of the same and/or different materials, and they may contain customized inscriptions and/or embedded elements which the particular person preparing such block wishes to present. As will be apparent to those skilled in the art, if only three such people desire to present such memory blocks, then three substantially rectangular blocks (such as blocks 128, 130, and 132) may be disposed in the space reserved for the particular deceased family member.

Figure 71:
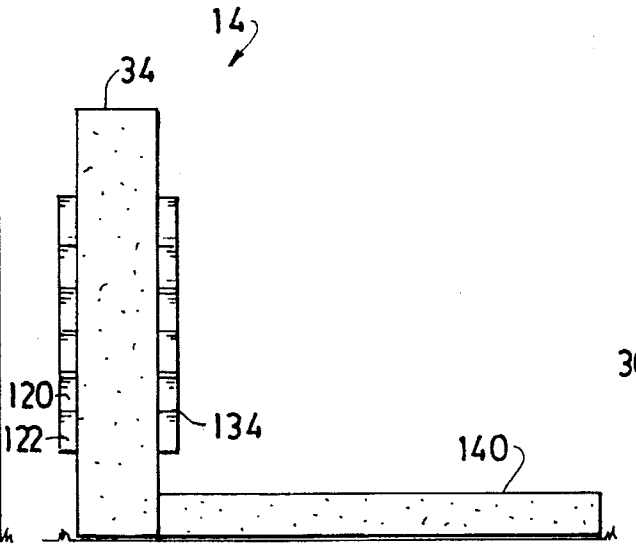
FIG. 71 is a side view of the monument of FIG. 70.

Referring to FIG. 71, and on the opposing face 30 of the body 14, a single block 134 may be inserted for such husband, e.g. in the lower right hand corner of orifice 118 (which preferably extends from face 30 to face 32). Thereafter, as the wife in the family dies, and the dog dies, blocks 136, 138 et seq. may be added.

The single blocks 134 et seq. preferably contain relevant information about the deceased in the form of an inscription 42. Such information may include birthplace, date of birth, date of death, place of death, name, etc.

Thus, by looking first at the face 30, a visitor may learn some essential facts about the deceased; and, thereafter, by looking at the memory blocks in back of the single blocks 134 et seq., the visitor may learn more about the values, beliefs, and accomplishments of the deceased.

Referring to FIG. 71, and in the preferred embodiment illustrated therein, a stone walkway 140 is provided for the visitor (not shown) to approach the front face 30 of the body 14.

FIGS. 81–86 illustrate a shelter 142 which is comprised of a roof 144, a floor 146, a bench 148, and a body 14 similar to that depicted in FIGS. 71 et seq. In the embodiments illustrated in FIGS. 83 and 84, an optional opening 150 is provided for glass (or stained glass) to allow the entry of light.

Figure 74:
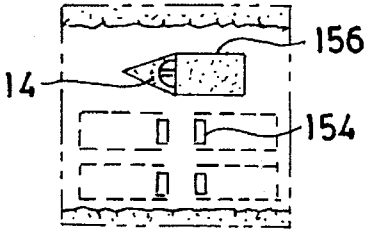
FIG. 74 is a site plan view of another preferred embodiment of the monument of this invention.

FIG. 74 is a site plan of a shelter 152 which is comprised of a body 14 and individual burial plot markers 154. The particular body 14 in such site plan is shown in more detail in FIGS. 75 through 80.

Figure 79:
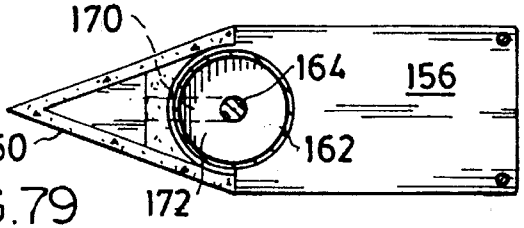
FIG. 79 is a plan section view of the monument of FIG. 74.
Figure 75:
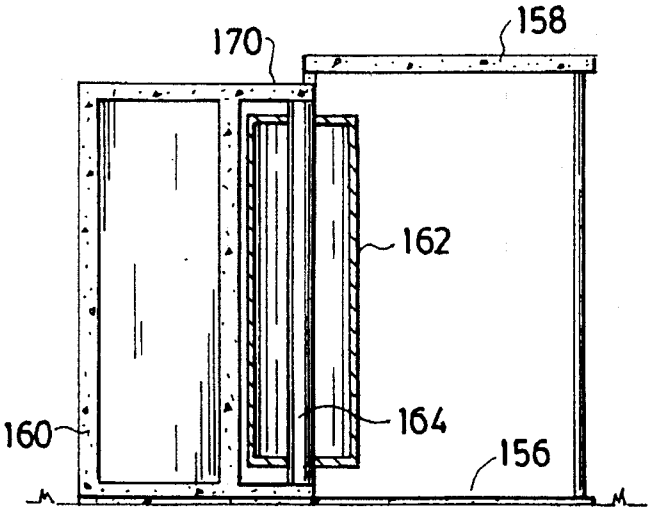
FIG. 75 is a sectional view of the monument of FIG. 74.

FIG. 75 is a sectional view of the body and shelter of FIG. 79, illustrating floor 156, roof 158, and body enclosure 160. Disposed within body 160 is rotatable cylinder 162 which is similar to, but substantially larger than, rotatable cylinder 50 (see FIG. 7). This cylinder 162 is vertically disposed within body 14, whereas cylinder 36 (see FIG. 1) was horizontally disposed within body 14.

Figure 77:
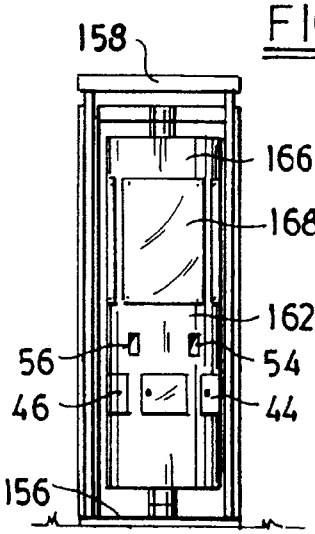
FIG. 77 is a front view of the monument of FIG. 74.

One preferred embodiment of cylinder 162 is illustrated in FIGS. 75 and 77. Referring to such Figures, it will be seen that cylinder 162 preferably is rotatably mounted on a shaft 164 so that such cylinder is suspended between the floor 156 and the roof 158. On the surface 166 of cylinder 162 are affixed one or more plates (such as a metal plate 168) which may be engraved with information about the life and times of the deceased. In one embodiment, one such plate 168 is affixed to the surface 166 of the cylinder 162 for each person buried within the plot.

Referring again to FIG. 77, it will be seen that rotatable cylinder 162 also is comprised of recessed pulls 54 and 56 and, additionally, one or more lockable compartments 44 equipped with lockable doors 46.

Referring again to FIGS. 75, 78, and 79, it will be seen that shaft 164 is preferably connected to body 160 with horizontally extending arm 170 which supports such shaft 164.

Figure 76:
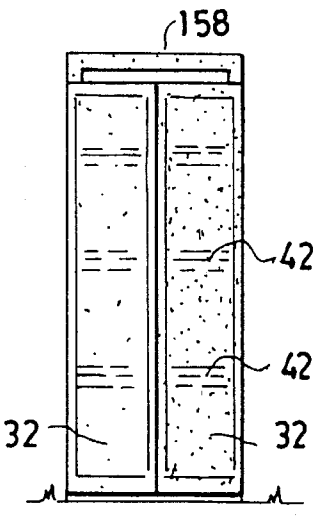
FIG. 76 is a rear view of the monument of FIG. 74.
Figure 86:
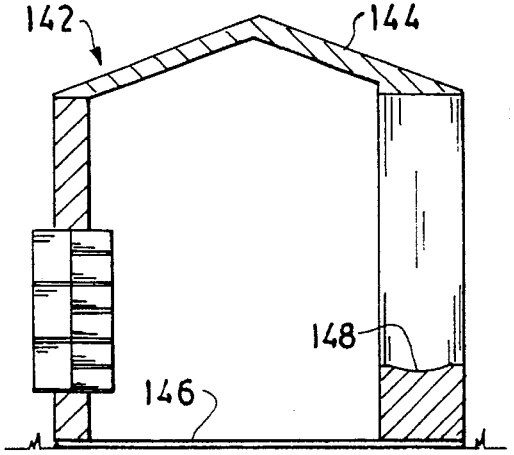
FIG. 86 is a sectional view of the monument of FIG. 81.
Figure 83:
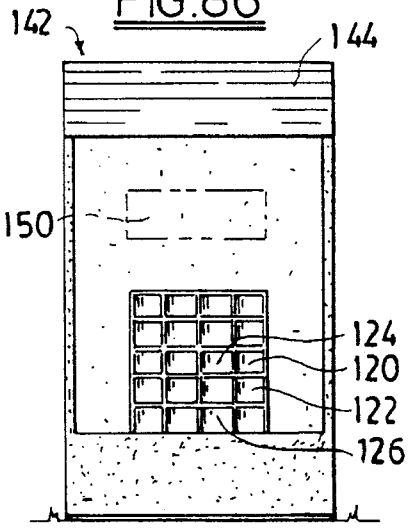
FIG. 83 is a front view of the monument of FIG. 81.
Figure 85:
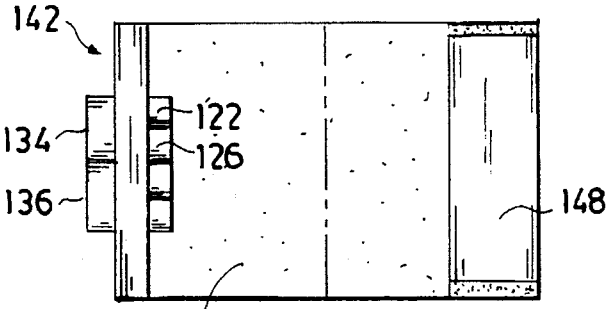
FIG. 85 is a plan view of the monument of FIG. 81.
Figure 82:
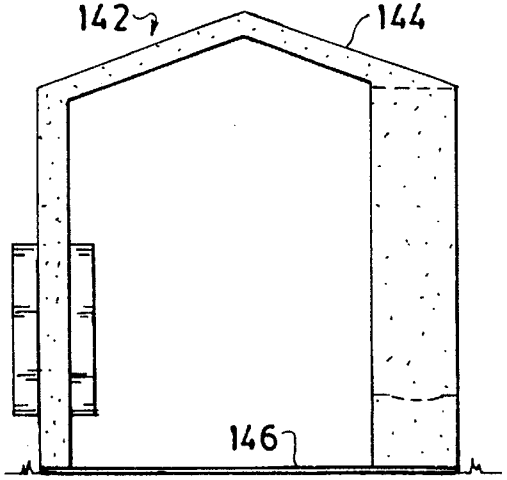
FIG. 82 is a side view of the monument of FIG. 81.
Figure 81:
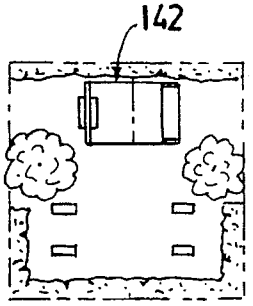
FIG. 81 is a site plan view of another preferred embodiment of the monument of this invention.
Figure 84:
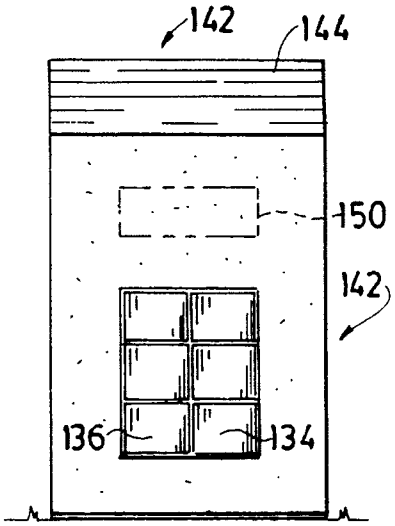
FIG. 84 is a rear view of the monument of FIG. 81.
Figure 88:
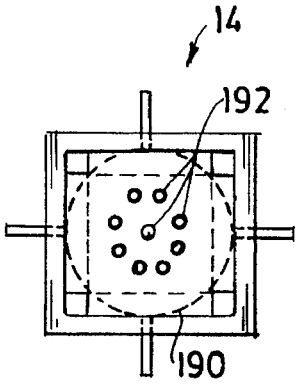
FIG. 88 is a plan view of the monument of FIG. 87.
Figure 90:
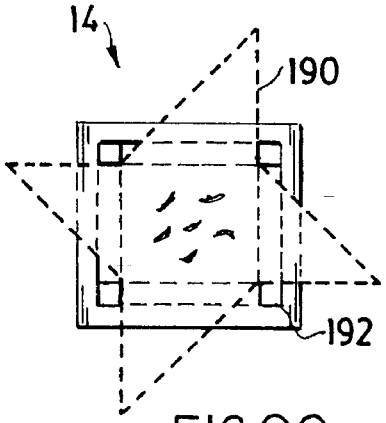
FIG. 90 is a plan view of the monument of FIG. 89.

Referring to FIG. 76, and in the preferred embodiment illustrated therein, it will be seen that back face 32 of body 14 is comprised of inscriptions 42 which contain information about each of the deceased within the plot.

In the preferred embodiment illustrated in FIGS. 74–80, it is preferred that cylinder 162 be substantially hollow so that it is relatively easy to rotate. Thus, to such end, one may construct cylinder 162 from a suitable strong, durable, relatively lightweight material such as, e.g., the materials discussed elsewhere in this specification.

Figure 78:
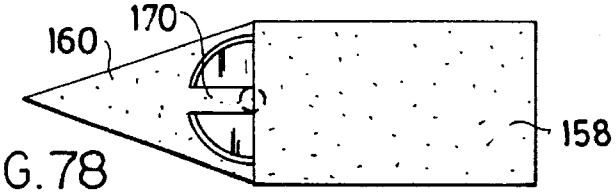
FIG. 78 is a plan view of the monument of FIG. 74.

In the embodiment illustrated in FIGS. 78 and 79, roof 158 does not cover the rear half 172 of cylinder 162, thus allowing sunlight to impact such portion 172 of the cylinder. In this embodiment, a reflective material 174 may be disposed between rear half 172 of the cylinder 162 and body 160, within arcuate slot 176. Thus sunlight will cause images from the rear half 172 of cylinder 162 to be reflected towards a visitor.

FIGS. 87 through 90 illustrate a body 14 comprised of at least one face 178 with a recess (not shown) disposed in its lower portion which is adapted to receive a plate 180 (such as, e.g., a metal plate) on which an inscription 42 appears. In the embodiment illustrated in FIGS. 87–90, the recess is comprised of a lower ledge 182 adapted to support an article such as, e.g., a bowl 184, a planter 186, a candle stick holder 188, and the like.

Referring again to FIGS. 87 through 90, it will be seen that the upper portion of body 14 is comprised of a cage 190 within which are disposed wind chimes 192 which are attached to the top 34 of body 14. The cage 190 allows wind to activate the wind chimes 192 but protects them from weather and vandals.

Figure 92:
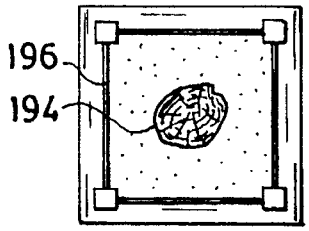
FIG. 92 is a plan view of the monument of FIG. 91.
Figure 87:
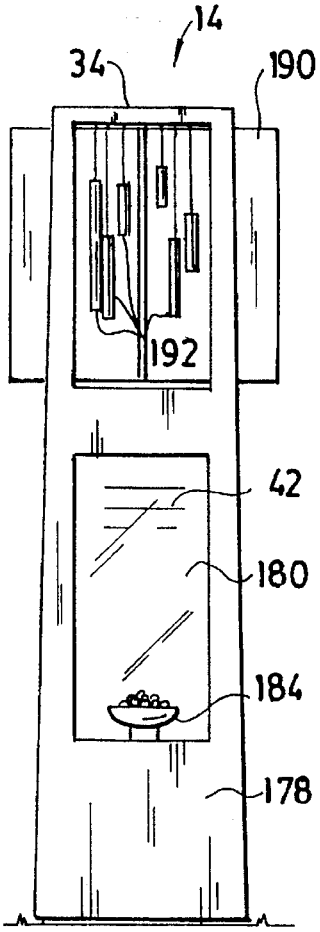
FIG. 87 an elevational view of another preferred embodiment of the monument of this invention.
Figure 89:
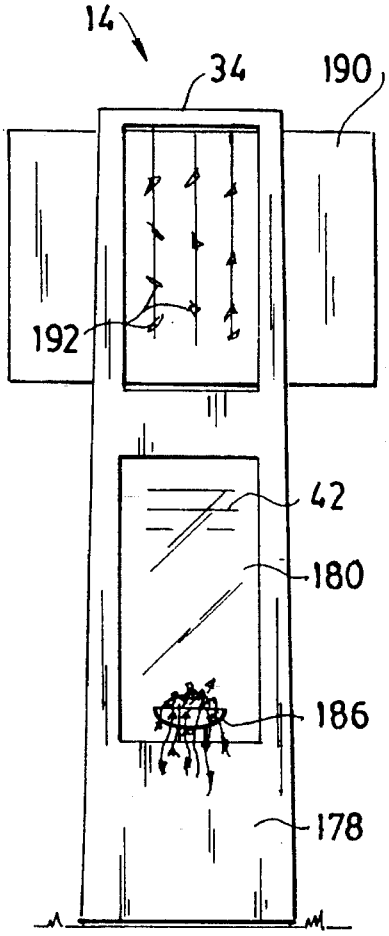
FIG. 89 is an elevational view of another preferred embodiment of the monument of this invention.
Figure 91:
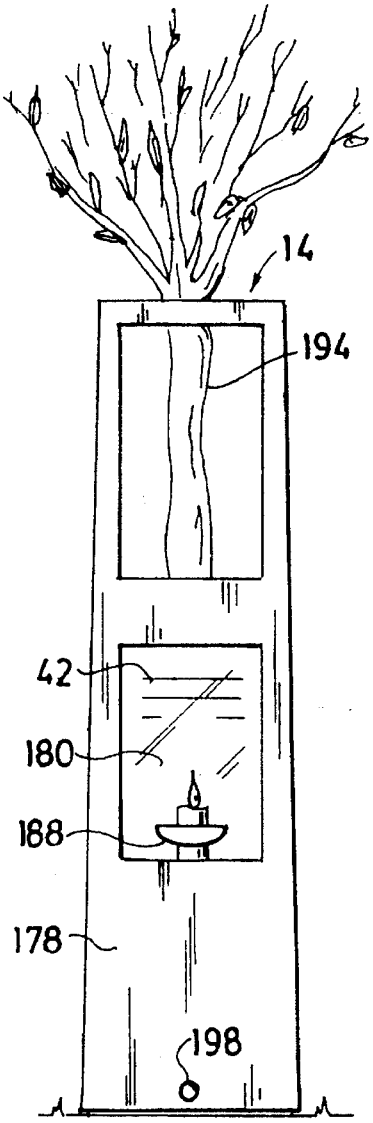
FIG. 91 is an elevational view of another preferred embodiment of the monument of this invention.

The embodiment of FIGS. 91 and 92 is similar to the embodiment of FIGS. 87 through 90 with the exception that the wind chimes 192 are replaced by plant (such as tree) 194, and the cage 190 is absent. In this embodiment, it is preferred to utilize a welded steel liner 196 to enclose the roots of the plant 194.

Suitable means may be used to drain water from plant 194 such as, e.g., drain cock 198.

Figure 95:
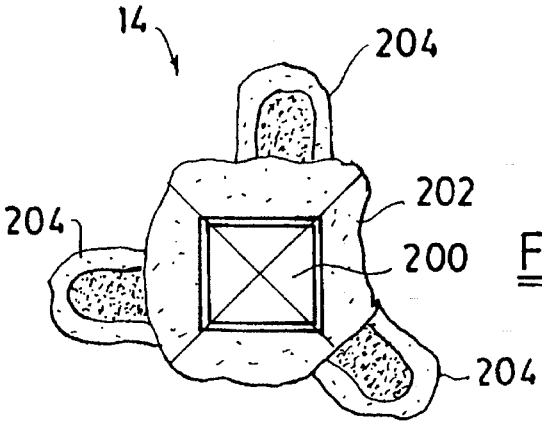
FIG. 95 is plan view of the monument of FIG. 93.
Figure 93:
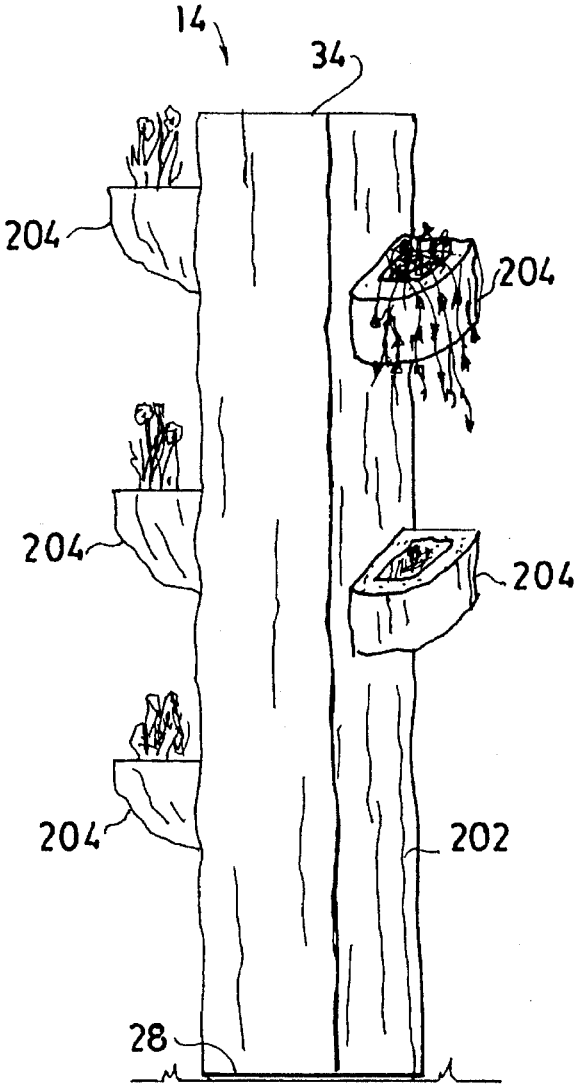
FIG. 93 is a perspective view of another preferred embodiment of the monument of this invention.
Figure 94:
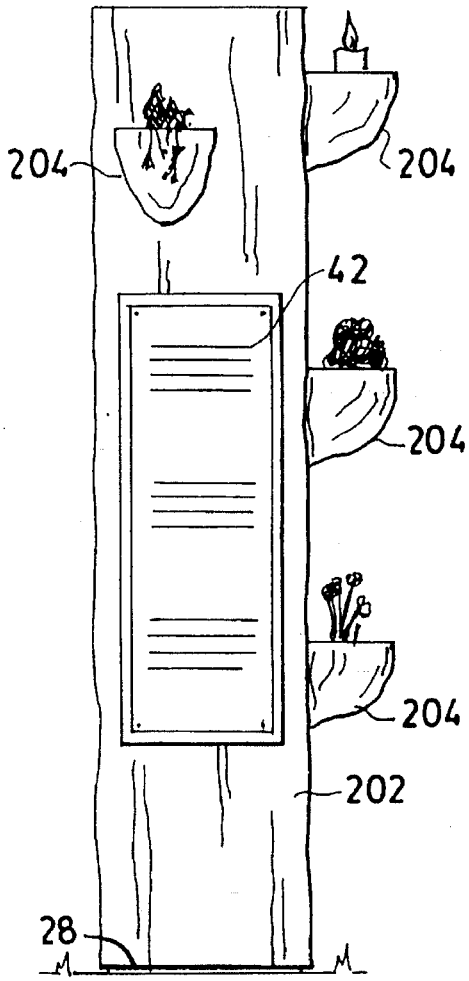
FIG. 94 is a front view of the monument of FIG. 93.

FIGS. 93 through 95 illustrate a body 14 which preferably contains a central orifice 200 extending from its top 34 to its bottom 28. In the embodiment illustrated in FIGS. 93 through 95, the body 14 is configured to resemble a tree trunk. Thus, its exterior surface 202 preferably presents a rough hewn appearance.

The body 14 preferably comprises a multiplicity of recesses adapted to receive irregularly shaped receptacles 204. These receptacles may be customized by the individual family members who present them for attachment to the body 14; and they may contain different plants, objects, and memory offerings given by different friends and family of the deceased.

Referring again to FIG. 94, it will be seen that at least one face 206 of body 14 used to support a plaque 208, which is mounted on such face and which may contain a suitable inscription 42.

Figure 98:
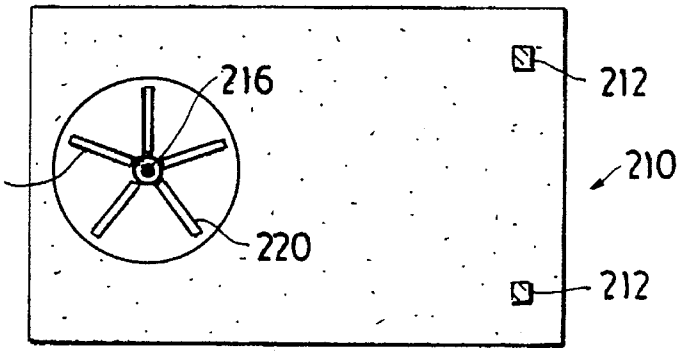
FIG. 98 is a plan view of the monument of FIG. 96.
Figure 97:
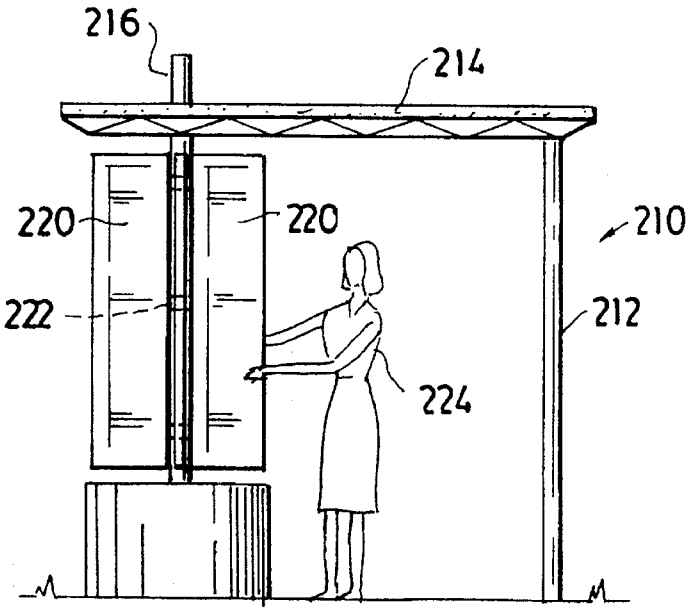
FIG. 97 is a side view of the monument of FIG. 96.
Figure 96:
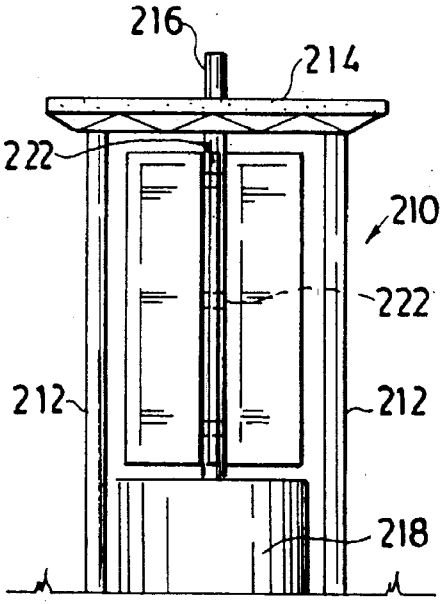
FIG. 96 a front view of another preferred embodiment of the monument of this invention.
Figure 99:
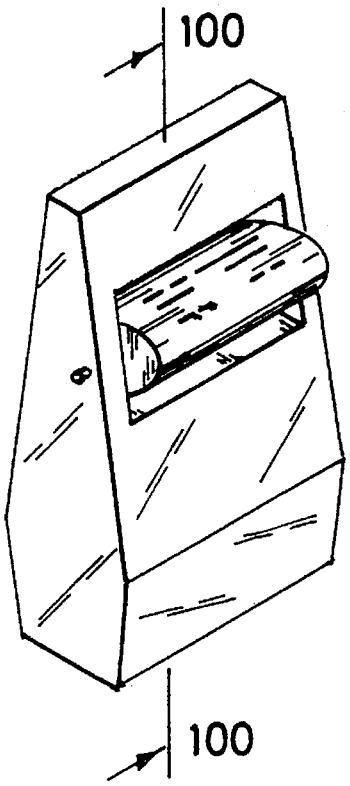
FIGS. 99 and 100 are perspective and side views, respectively, of a monument with a rotatable element which has an oval shape.
Figure 100:
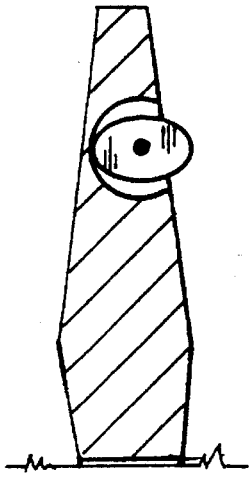

FIGS. 96 through 98 illustrate a structure 210 comprising a support 212 and a roof 214. Mounted within roof 214 is fixed shaft 216, which is connected to and supported by base 218 and which, in the preferred embodiment illustrated in FIGS. 96 through 98, supports roof 214.

Disposed around fixed shaft 216 is a multiplicity of leaves (such as metal leaves) 220 which are each preferably rotatably connected to shaft 216 by means of collars 222. It is preferred that each such metal leaf 220 be connected to shaft 216 by at least two of its own collars 222. Thus, these leaves 220 may be rotated around shaft 216 so that a visitor 224 may view the front and back of any one such leaf prior to the time he views the next such leaf.

As will be seen by reference to FIG. 97, movable leaves 220 are disposed so that they contact neither roof 214 nor base 218. One or more inscriptions may be made onto the surface(s) of one or more of such leafs in manner discussed elsewhere in this specification; thus, e.g., words may be cut through such leafs. Photographs, newspaper clippings, letters, and other documents may be attached to leafs. Thus, e.g., each such leaf may be assigned to one person buried in the plot, and suitable inscriptions may be made in the front and back of the leafs in the manner, e.g., described for the embodiment of FIG. 1.

In one embodiment, not shown, a viewing chamber comprised of a document to be viewed and a means of magnifying such document (such as the chamber 102 of FIG. 50) may be incorporated into any of the embodiments of this invention.

Figure 4:
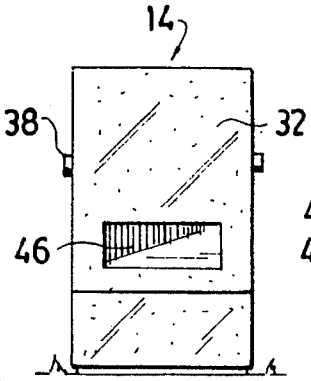
FIG. 4 is a rear view of the monument of FIG. 1.

In another embodiment, not shown, one or more of the memory blocks 114 (see FIG. 69) may be replaced by a locking receptacle 44 equipped with a door 46 (see FIG. 4).

In another embodiment, not shown, instead of inscribing a surface of a body 14 (or instead of inscribing a plate attached to such surface), one may attach a photograph, a letter, or other document relating to the deceased.

In another embodiment, not shown, one or more of the bodies 14 is equipped with a solar powered lighting system wherein the light can be on during the daytime and off at nighttime, or vice versa. In this embodiment, such a solar powered light can be used, in part or whole, as a substitute for the candles discussed in this specification.

In another embodiment, not shown, one may equip one or more of the bodies 14 discussed herein with a video display activated by a switch. Such video display may be used, in whole or part, as a substitute for the metal plates discussed herein. In addition, one may use a touch sensitive screen to learn about the life of the deceased.

In another embodiment, not shown, one may equip one or more of bodies 14 with audio recordings in place of, in whole or in part, the video recordings discussed above. Alternatively, one may use video and audio recordings simultaneously.

In another embodiment, any of the metal plates and/or any of the mosaics and/or any of the stained glass discussed hereinabove may be replaced, in whole or in part, with dichroic mirror glass. As is known to those skilled in the art, a dichroic mirror is a glass surface coated with a special metal film that reflects certain colors of light while allowing others to pass through.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A monument comprised of a body, means for permanently attaching said body to the ground, and a rotatable element rotatably attached to said body, wherein:

(a) said body is comprised of an exterior surface, (b) said exterior surface is comprised of an opening, (c) at least a portion of said rotatable element is disposed within said opening, and (d) said monument is comprised of means for continuously rotating said rotatable element, (e) said rotatable element is comprised of means for displaying visual information which varies as said rotatable element is rotated;

(f) said means for permanently attaching said body to said ground is comprised of a concrete member; and (g) said rotatable element is a cylinder.

2. The monument as recited in claim 1, wherein said means for rotating said rotatable element is comprised of a knob.

3. The monument as recited in claim 1, wherein said means for rotating said rotatable element is comprised of a recess pull.

4. A monument comprised of a body, means for permanently attaching said body to the ground, and a rotatable element rotatably attached to said body, wherein:

(a) said body is comprised of an exterior surface, (b) said exterior surface is comprised of an opening, (c) at least a portion of said rotatable element is disposed within said opening, and (d) said monument is comprised of means for rotating said rotatable element, (e) said rotatable element is comprised of means for displaying visual information which varies as said rotatable element is rotated;

(f) said means for permanently attaching said body to said ground is comprised of a concrete member; and (g) said rotatable element is a sphere.

5. A monument comprised of a body, means for permanently attaching said body to the ground, and a rotatable element rotatably attached to said body, wherein:

(a) said body is comprised of an exterior surface, (b) said exterior surface is comprised of an opening, (c) at least a portion of said rotatable element is disposed within said opening, and (d) said monument is comprised of means for rotating said rotatable element, (e) said rotatable element is comprised of means for displaying visual information which varies as said rotatable element is rotated;

(f) said means for permanently attaching said body to said ground is comprised of a concrete member; and (g) said rotatable element has a substantially oval shape.

6. A shelter comprised of a monument, a roof disposed over such monument, and means for supporting said roof, wherein said monument is comprised of a body, means for permanently attaching said body to the ground, and a rotatable element rotatably attached to said body, and wherein:

(a) said body is comprised of an exterior surface, (b) said exterior surface is comprised of an opening, (c) at least a portion of said rotatable element is disposed within said opening, (d) said monument is comprised of means for rotating said rotatable element, and (e) said rotatable element is comprised of means for displaying visual information which varies as said rotatable element is rotated.

7. The shelter as recited in claim 6, wherein said shelter is comprised of a floor.

8. The shelter as recited in claim 7, wherein said shelter is comprised of a bench.

9. The shelter as recited in claim 8, wherein said rotatable element is comprised of a first recess.

10. The shelter as recited in claim 9, wherein said rotatable element is comprised of a second recess and a first door.

11. The shelter as recited in claim 10, wherein said rotatable element is comprised of a third recess and a second door.

12. The shelter as recited in claim 11, wherein said rotatable element is a cylinder.

13. The shelter as recited in claim 12, wherein said rotatable element is a sphere.

14. The shelter as recited in claim 11, wherein said roof covers only a portion of said rotatable element.

15. The shelter as recited in claim 14, wherein said means for rotating said rotatable element is comprised of a recess pull.

* * * * *